US008647000B2

(12) United States Patent
Shinozaki et al.

(10) Patent No.: US 8,647,000 B2
(45) Date of Patent: Feb. 11, 2014

(54) RECORDING APPARATUS AND DRIVING CONTROL METHOD THEREOF

(75) Inventors: Nobuhiko Shinozaki, Shiojiri (JP); Shintaro Komuro, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 370 days.

(21) Appl. No.: 12/875,346

(22) Filed: Sep. 3, 2010

(65) Prior Publication Data

US 2011/0057382 A1 Mar. 10, 2011

(30) Foreign Application Priority Data

Sep. 4, 2009 (JP) ..... 2009-204595

(51) Int. Cl.
*B41J 13/16* (2006.01)
*B41J 13/18* (2006.01)

(52) U.S. Cl.
USPC ..... 400/525; 400/527; 400/528

(58) Field of Classification Search
CPC ..... B41J 3/4071
USPC ..... 400/48, 642, 500, 521, 525, 527, 527.1, 400/528, 59; 347/164
See application file for complete search history.

(56) References Cited

U.S. PATENT DOCUMENTS

| | | | | |
|---|---|---|---|---|
| 6,869,235 | B2 * | 3/2005 | Kawaguchi et al. | 400/59 |
| 7,101,096 | B2 * | 9/2006 | Sasai et al. | 400/48 |
| 7,325,898 | B2 * | 2/2008 | Kawazoe et al. | 347/19 |
| 7,341,339 | B2 * | 3/2008 | Yoshikaie | 347/104 |

FOREIGN PATENT DOCUMENTS

| | | | |
|---|---|---|---|
| JP | 2001210000 | A * | 8/2001 |
| JP | 2002-096514 | | 4/2002 |
| JP | 2004-042391 | | 2/2004 |
| JP | 2004-082540 | | 3/2004 |
| JP | 2005-074907 | | 3/2005 |
| JP | 2005-335911 | | 12/2005 |
| JP | 2007-118440 | | 5/2007 |
| JP | 2007-176639 | | 7/2007 |

* cited by examiner

*Primary Examiner* — Matthew G Marini
*Assistant Examiner* — John M Royston
(74) *Attorney, Agent, or Firm* — Workman Nydegger

(57) ABSTRACT

Provided is a recording apparatus including: a holding tray which is inserted in a transportation path facing a recording head, and is capable of holding a recording medium on a front surface thereof, the holding tray having a plane area used to horizontally hold the recording medium and a sloped area provided in a rear end in a transportation direction and inclined toward a rear surface thereof as it becomes closer to a rear edge; a driving roller which comes into contact with the rear surface of the holding tray; a driven roller which comes into contact with the front surface of the holding tray and pinches the holding tray between the driving roller and the driven roller; and a control device which controls the driving roller in response to the case of transporting the plane area of the holding tray and the case of transporting the sloped area thereof.

5 Claims, 8 Drawing Sheets

RECORDING APPARATUS AND DRIVING CONTROL METHOD THEREOF

BACKGROUND

1. Technical Field

The present invention relates to a recording apparatus of a concept including a multi-functional device represented by a printer, a facsimile, or a copier which sets a recording medium such as an optical disk on a holding tray, moves the holding tray using a transportation means, and then performs a recording operation on the recording medium in a recording area, and a driving control method thereof.

2. Related Art

In an ink jet printer as an example of a recording apparatus, there is an ink jet printer capable of selectively performing a recording operation on both a soft recording medium such as a paper sheet or a film and a hard recording medium represented by an optical disk (a CD-R, a DVD-R, and the like). In addition, in the case where a recording operation is performed on a recording medium such as a CD-R, an exclusive holding tray prepared as a separate component is used, or an ink jet printer having a holding tray built in a printer body is used. The holding tray is provided with a setting concave portion which is used to set a recording medium such as a CD-R thereon.

JP-A-2004-82540 is an example of related art.

As described above, in the case of a structure in which the recording operation is performed on the recording medium such as a CD-R by using the holding tray as a separate component, the lower surface of the holding tray is formed to be long in the transportation direction so that the recording operation can be performed while the lower surface is supported by a transportation driving roller and a discharge driving roller located on the downstream side of the recording head. Accordingly, there is an increase in the size of the component.

Further, in a printer of a type which has the built-in holding tray, it is necessary to decrease the size of the holding tray, in order to prevent an increase in the size of the apparatus. Since the discharge driving roller cannot be used structurally when the size of the holding tray is decreased in the transportation direction, the holding tray is transported while being pinched between the transportation driving roller and a driven roller opposite thereto.

However, a problem arises in the form of variation in the feeding amount of the holding tray during a transportation operation, caused by a slope for guiding the driven roller provided on the rear end in the transportation direction of the holding tray. That is, since the dimension of the holding tray is decreased in the transportation direction, the driven roller comes into contact with the slope during the recording operation. Accordingly, the holding tray is pushed in the transportation direction by a pinching force of the driven roller and the transportation driving roller, thereby causing a problem in that the recording operation cannot be performed satisfactorily.

In related art, the holding tray can have a configuration in which a guide slope is provided on the rear end of the holding tray, with the holding tray formed to be long enough in the transportation direction, such that the slope does not come into contact with the transportation driving roller and the driven roller used for a supporting operation while the recording operation is performed on the recording medium. For this reason, the aforementioned problem does not arise.

SUMMARY

An advantage of some aspects of the invention is that it provides a recording apparatus capable of performing a satisfactory image recording operation by suppressing variation in the feeding amount of a holding tray during a transportation operation so that the feeding amount is uniform, and a driving control method thereof.

According to an aspect of the invention, there is provided a recording apparatus including: a holding tray which is inserted in a transportation path facing a recording head, is capable of holding a recording medium on a front surface thereof, and then has a plane area used to horizontally hold the recording medium and a sloped area provided at the rear end in a transportation direction and inclined toward a rear surface thereof as it becomes closer to a rear edge; a driving roller which comes into contact with the rear surface of the holding tray; a driven roller which comes into contact with the front surface of the holding tray and pinches the holding tray between the driving roller and the driven roller; and a control device which controls the driving roller in response to the case of transporting the plane area of the holding tray and the case of transporting the sloped area.

With such a configuration, since a control device is provided which controls the driving operation of the driving roller so that the feeding amount of the holding tray is changed in response to the plane area and the sloped area thereof, it is possible to perform a satisfactory recording operation by suppressing a variation in the feeding amount of the holding tray during the transportation operation thereof so that the feeding amount is uniform.

Further, the control devices may have a function of controlling the driving roller so that the rotation amount is reduced in the case of transporting the sloped area of the holding tray, compared with the case of transporting the plane area thereof.

With such a configuration, since it is possible to suppress an increase in the transportation speed in the sloped area of the holding tray by using the pinching force of the transportation roller and the driven roller, it is possible to correct the feeding amount by using the plane area and the sloped area of the holding tray so that the feeding amount is uniform.

Further, the holding tray may include a holding portion which is provided in the plane area so as to hold the recording medium. The distance from the rear end of the holding portion in the transportation direction to the sloped area may be shorter than a distance from a nipping point between the driving roller and the driven roller to a recording position using the recording head.

With such a configuration, the sloped area of the holding tray reaches the nipping point between the driving roller and the driven roller before the recording operation performed on the recording medium ends. However, since the driving roller is controlled so that the feeding amount of the holding tray is changed in response to the plane area and the sloped area thereof, it is possible to transport the holding tray at a uniform feeding amount without increasing the transportation speed in the sloped area of the holding tray.

According to another aspect of the invention, there is provided a driving control method of controlling a driving operation of a transportation driving roller in response to the cases of transporting a plane area of a holding tray and transporting a sloped area thereof when the holding tray is transported while being pinched between a driving roller coming into contact with a rear surface of the holding tray and a driven roller coming into contact with a front surface of the holding tray, where the holding tray is inserted in a transportation path facing a recording head, and is capable of holding a recording medium on a front surface thereof, the holding tray having a plane area used to horizontally hold the recording medium and a sloped area provided at the rear end in a transportation direction and inclined toward a rear surface thereof as it becomes closer to a rear edge.

With such a configuration, since the driving operation of the driving roller is controlled so that the feeding amount of the holding tray is changed in response to the plane area and the sloped area thereof during the transportation operation of the holding tray, it is possible to perform a satisfactory image recording operation by suppressing variation in the feeding amount of the holding tray so that the feeding amount is uniform.

Further, the driving roller may be controlled so that the rotation amount is further reduced in the case of transporting the sloped area of the holding tray, compared with the case of transporting the plane area thereof.

With such a configuration, since the rotation amount of the driving roller is reduced, it is possible to suppress an increase in the transportation speed in the sloped area of the holding tray by using the pinching force of the transportation roller and the driven roller, and to correct the feeding amount of the holding tray so that the feeding amount is uniform due to the plane area and the sloped area thereof.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the accompanying drawings. In addition, in the respective drawings used in the description below, the scales of the respective members are appropriately changed so that the respective members can be recognized.

Figure 1:
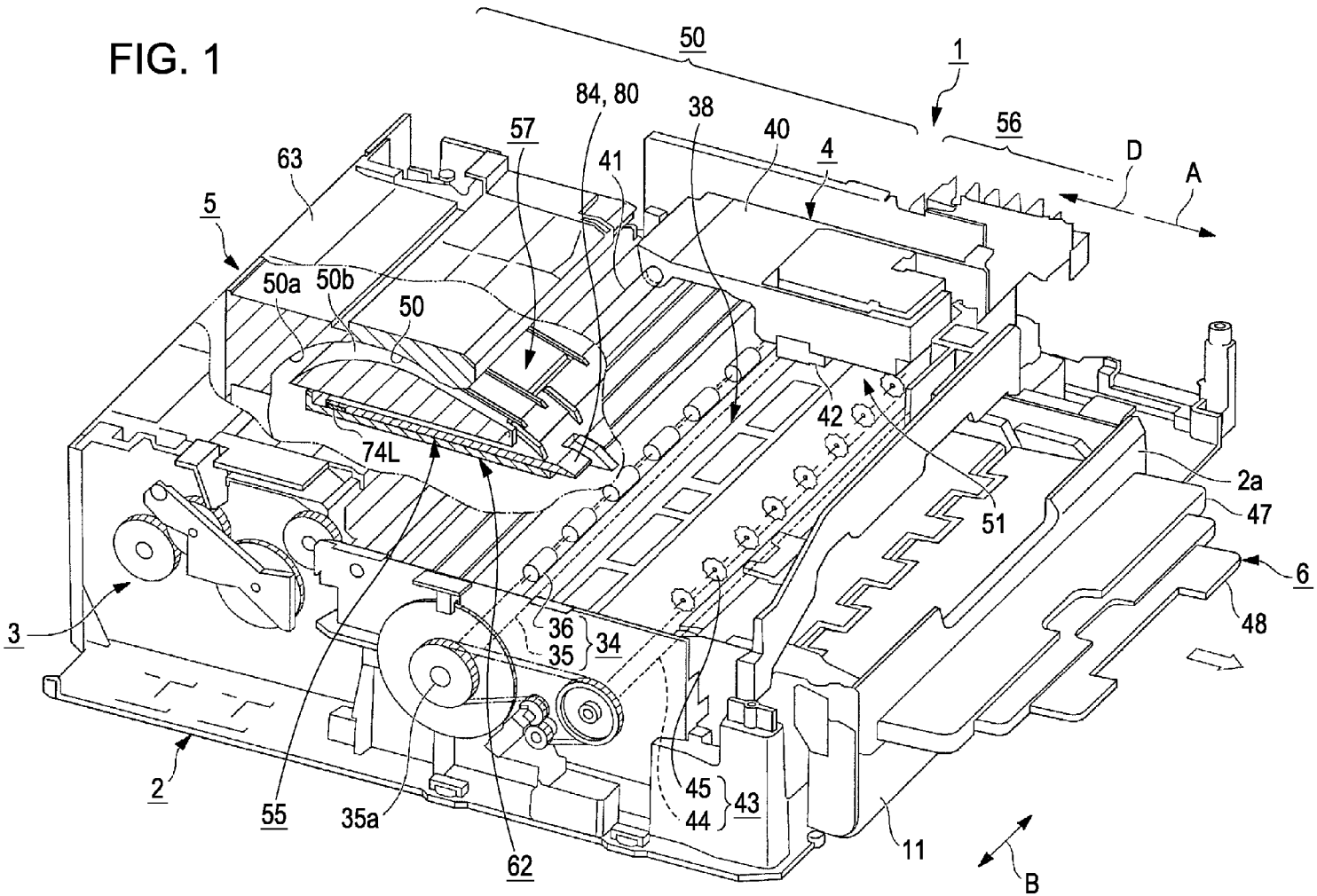
FIG. 1 is a perspective view illustrating an internal structure of an ink jet printer according to an embodiment of the invention.
Figure 2:
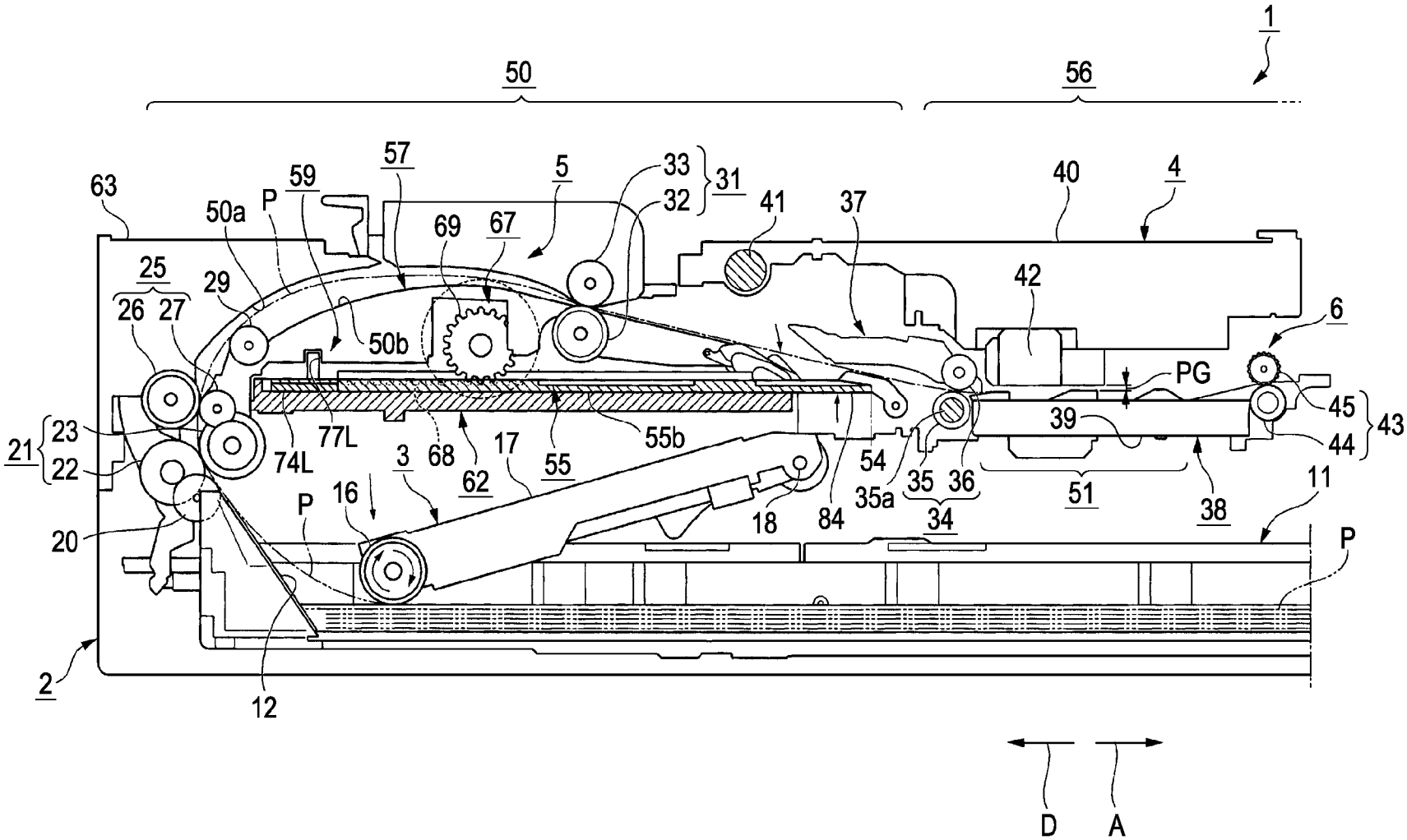
FIG. 2 is a side sectional view when a holding tray is located at an accommodation position.
Figure 3:
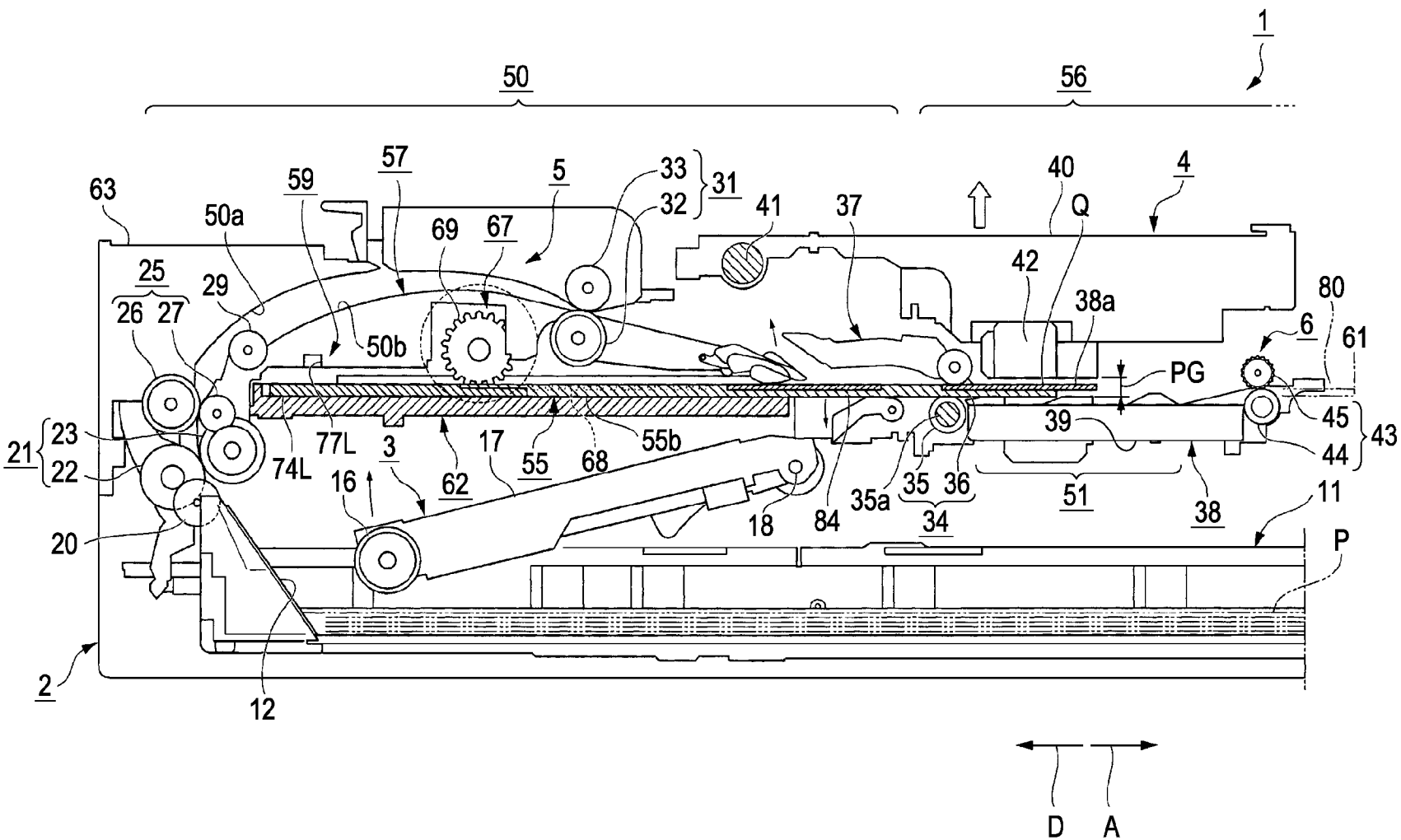
FIG. 3 is a side sectional view when the holding tray is located at a recording start position (recording end position).
Figure 4:
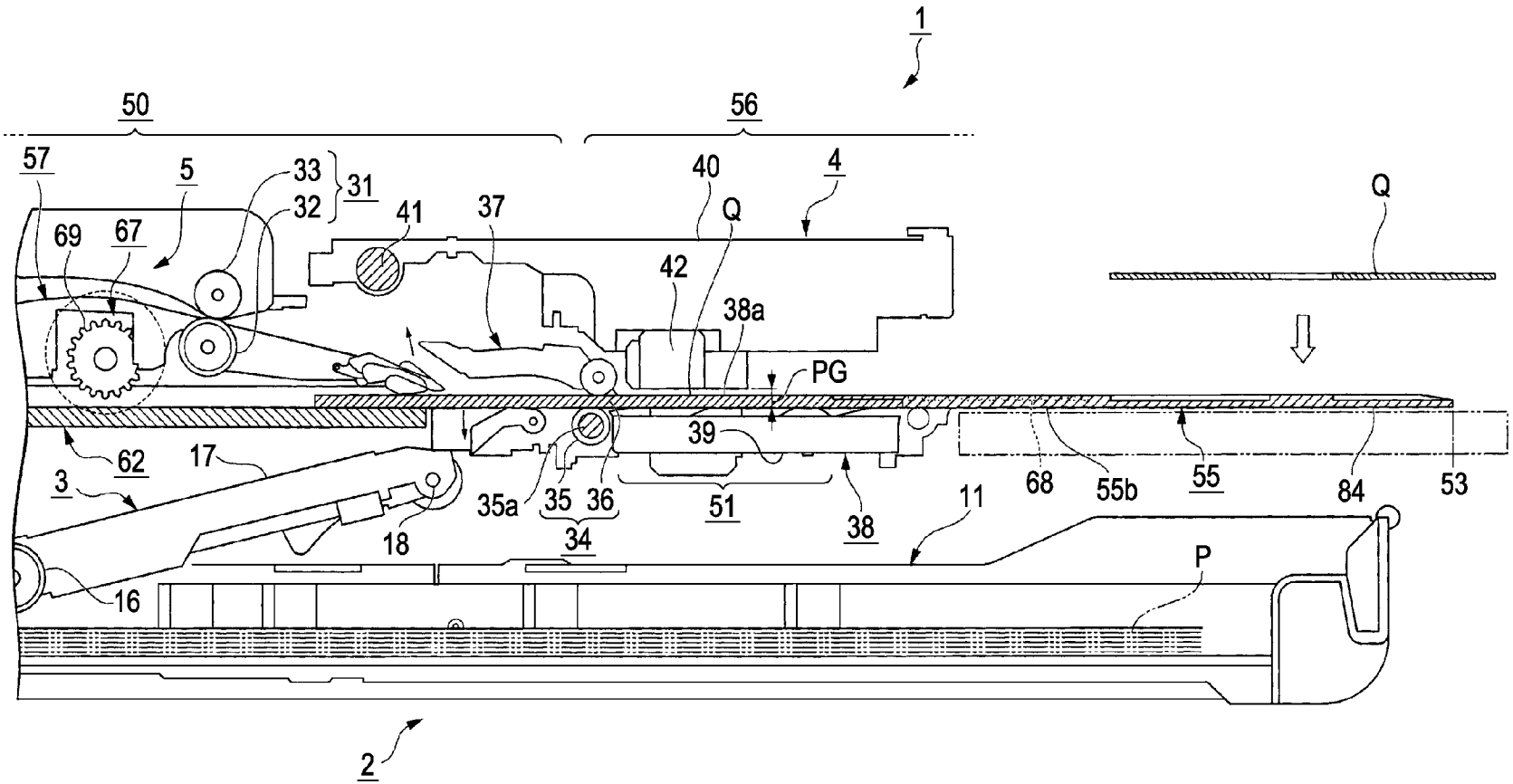
FIG. 4 is a side sectional view when the holding tray is located at a setting position.

FIG. 1 is a perspective view illustrating an entire internal structure of an ink jet printer. FIG. 2 is a schematic configuration diagram illustrating a configuration of the ink jet printer, and is a side sectional view when a holding tray is located at an accommodation position. FIG. 3 is a side sectional view when the holding tray is located at a recording start position (recording end position). FIG. 4 is a side sectional view when the holding tray is located at a setting position.

In addition, an ink jet printer 1 shown in the drawings is a multi-functional ink jet printer having an image reading device (scanner) not shown in the drawings and mounted to an upper portion thereof, and is an ink jet printer capable of performing a recording operation on a soft recording medium P such as a paper sheet or a film and a hard recording medium (recording medium) Q such as an optical disk including a CD-R or a DVD-R. Further, the ink jet printer 1 shown in the drawing is a serial printer in which a recording head 42 is mounted to a lower surface of a carriage 40 adapted to be movable in the width direction B intersecting the transportation direction A in a recording area 51 of two types of recording mediums P and Q.

As illustrated in FIGS. 1 and 2, the ink jet printer 1 includes a printer body 2 which is formed in a rectangular case shape having an external shape formed by comparatively flat surfaces. The printer body 2 includes a control device 200 (refer to FIG. 6) controlling the entire operation, a feeding device 3, a recording device 4, a transportation device 5, a discharge device 6, and the like.

The control device 200 (refer to FIG. 6) electrically controls the operation of each of the devices. Although it will be described later in detail, the control device 200 includes various input/output interface circuits which transmit and receive data between the feeding device 3, the recording device 4, the transportation device 5, the discharge device 6, and the like, a CPU which executes a predetermined calculation operation on the basis of the data, and the like.

A feeding cassette 11 is detachably mounted to a central lower portion of a front surface 2*a* of the printer body 2 so as to accommodate a plurality of soft recording mediums P such as normal paper sheets in a piled manner.

In addition, a discharging stacker 47 is installed in the upper portion of the mounting surface of the feeding cassette 11 so as to stack the soft recording mediums P subjected to the recording operation in a piled manner. Further, the front surface 2*a* of the printer body 2 is provided with operation buttons (not shown) used for performing various operation instructions, a cartridge holder (not shown) used for accommodating various ink cartridges, and the like.

The feeding cassette 11 is a member which is installed at the start position of the transportation path of the recording medium P, and the soft recording mediums P accommodated inside the feeding cassette 11 are sequentially transported one by one from the uppermost one thereof by the feeding device 3 to be fed toward a U-shaped reversing path 50.

The feeding device 3 includes a pickup roller 16 which extracts the upper soft recording medium P backwards inside the feeding cassette 11, a separating slope 12 which guides the upper soft recording medium P toward the U-shaped reversing path 50 while preliminarily separating the soft recording medium P extracted backwards, a first guide roller 20 which is installed in the upper portion of the rear slope of the separating slope 12 in a freely rotatable manner, and a separating roller 21 which is installed in the upper portion of the rear slope of the first guide roller 20.

The pickup roller 16 is installed in a front end of a swinging arm 17 which swings about a swinging shaft 18, and is adapted to extract the uppermost recording medium P backwards inside the feeding cassette 11 by rotation in the transportation direction A while pressing the surface of the soft recording medium P during a feeding operation.

The separating roller 21 is configured as a pair of nipping rollers which has a separating driving roller 23 and a separating driven roller 22 connected to a torque limiter, and plays a role of completely separating the subsequent recording medium P from the uppermost soft recording medium P, where the recording mediums cannot be completely separated from each other by the preliminary separating operation using the separating slope 12.

The soft recording medium P fed by the feeding device 3 is transported along the U-shaped reversing path 50 inside the transportation device 5, and is guided to the recording area 51. The lower portion of the recording area 51 is provided with a platen 38 which defines a gap PG between the platen and the lower surface (nozzle formation surface) of the recording head 42 while supporting the lower surface of the holding tray 55 or the like for holding the transported soft recording mediums P and hard recording mediums Q.

Meanwhile, the upper portion of the recording area 51 is provided with the recording head 42 and the carriage 40 adapted to be movable in a reciprocating manner and guided by a carriage guide shaft 41 in the width direction B while having the recording head 42 mounted to the lower surface thereof, where the recording head 42 and the carriage 40 correspond to the main constituting members of the recording device 4. Further, the recording device 4 includes a plurality of ink tubes (not shown) used for supplying respective colors of inks to the recording head 42, an ink supply pump, a capping device (not shown) installed at the home position of the carriage 40, an automatic gap adjusting mechanism (not shown) used for the exchange of the soft recording medium P and the hard recording medium Q, and the like.

In addition, the discharge device 6 for the recording medium is installed at the downstream position in the transportation direction A of the recording area 51. The discharge device 6 for the recording medium includes a discharge roller 43 configured as a pair of nipping rollers having a discharging driving roller 44 and a discharging driven roller 45, and the above-described stacker 47.

Further, an extension stacker 48 is installed in the box-shaped internal portion of the discharging stacker 47 so as to be extracted therefrom or accommodated therein.

Next, the configuration of the transportation device 5 of the embodiment will be described in detail.

Figure 5A:
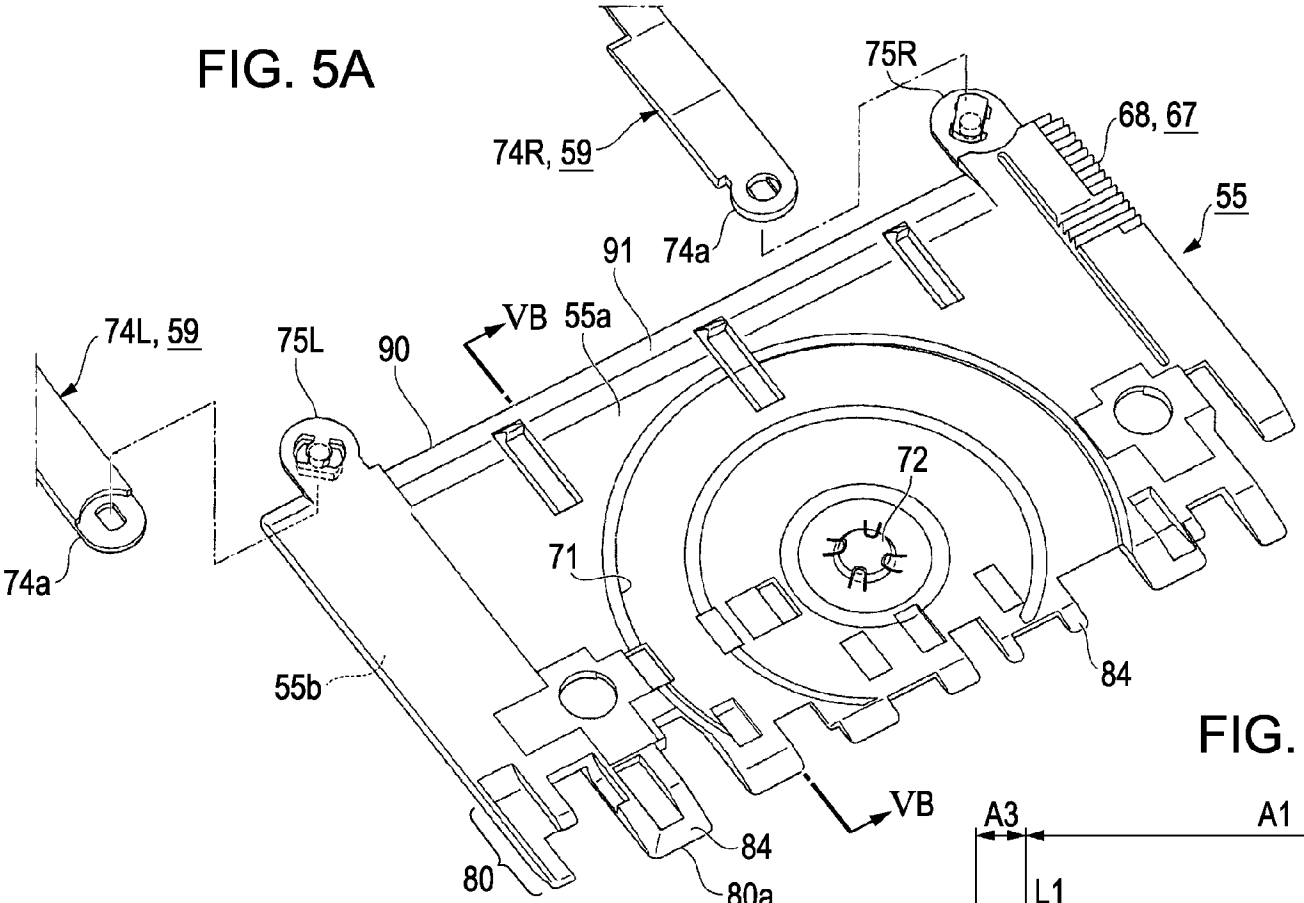
FIG. 5A is a perspective view illustrating a schematic configuration of the holding tray.
Figure 5B:
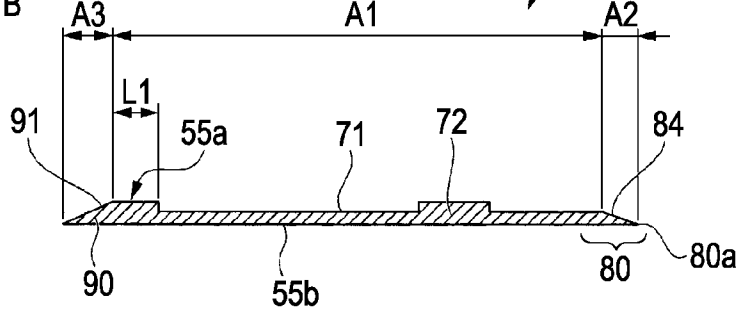
FIG. 5B is a sectional view taken along the line VB-VB of FIG. 5A.

FIG. 5A is a perspective view illustrating a schematic configuration of the holding tray, and FIG. 5B is a sectional view taken along the line VB-VB of FIG. 5A.

The transportation device 5 basically includes a short holding tray 55 which is built in the printer body 2 so as to set the hard recording medium Q such as a CD-R thereon, a reciprocation movement path 56 which guides the reciprocation movement of the holding tray 55 between the setting position 53 (refer to FIG. 4) and the accommodation position 54 (refer to FIG. 2), and a transportation roller 34 which has a transportation driving roller 35 and a transportation driven roller 36 used for applying a transportation force to the holding tray 55 while being installed in the course of the reciprocation movement path 56.

In addition to the above-described configuration, the transportation device 5 includes the above-described feeding cassette 11 which is capable of accommodating a plurality of the soft recording mediums P in a piled manner, the above-described U-shaped reversing path 50 which guides the backward feeding operation of the soft recording medium P from the feeding cassette 11, the U-shaped reversing operation thereof, and the transportation operation thereof toward the front surface 2*a* of the printer body 2, and an auxiliary transportation mechanism 67 which performs an auxiliary transportation operation until the holding tray 55 is transported by the transportation roller 34.

Here, the recording area 51 is an area where a recording operation is performed on the hard recording medium Q by using the recording head 42. In FIG. 3, the reference numeral 60 indicates the position of the front end of the holding tray 55 when starting to perform the recording operation on the hard recording medium Q. Hereinafter, the position is referred to as a recording start position 60 of the holding tray 55. In correspondence to the recording start position 60, the position of the front end of the holding tray 55 upon ending the recording operation of the hard recording medium Q corresponds to a recording end position 61 of the holding tray 55. In FIG. 3, the reference numeral 61 indicates the position of the front end of the holding tray 55 at the recording end position.

The U-shaped reversing path 50 is installed by using a rear space inside the printer body 2. As an example of forming an outer guide surface 50*a* of the U-shaped reversing path 50, the transportation path for the soft recording medium P is constituted by upper housings 63 and 64 which are divided into two parts and are located at the upper portion, an upper transportation guide portion 37, a lower housing 65 which is located at the lower portion, and the upper path constituting member 57 forming an inner guide surface 50*b* of the U-shaped reversing path 50.

As illustrated in FIG. 3, the U-shaped reversing path 50 is provided with a first intermediate feeding roller 25 which is configured as a pair of nipping rollers having a feeding driving roller 26 and a feeding driven roller 27 and a second intermediate roller 31 which is configured as a pair of nipping rollers having a feeding driving roller 32 and a feeding driven roller 33 and a second guide roller 29 adapted to be freely rotatable. In addition, the soft recording medium P supplied to the U-shaped reversing path 50 by the feeding and guiding operations of the respective rollers 25, 29, and 31 is allowed to be supplied to the nipping point of the transportation roller 34 installed in a position in the vicinity of the downstream of the U-shaped reversing path 50 via the U-shaped reversing path 50.

The transportation roller 34 is configured as a pair of nipping rollers having the transportation driving roller 35 supported by a roller driving shaft 35*a* and the transportation driven roller 36 adapted to be freely rotatable about the front end of the upper transportation guide portion 37. In addition, the position of the transportation direction A of the transportation driven roller 36 is set as a so-called "reverse structure" in which the position is slightly deviated to the downstream of the position of the transportation direction A of the transportation driving roller 35. In addition, by adopting the transportation roller 34 having such a "reverse structure", since the front end of the supplied soft recording medium P is pressed by a lower platen rib 38*a* so as not to rub the head, it is possible to improve the recording quality.

In addition, since power is transmitted from a driving motor 7 to be described later to the roller driving shaft 35*a*, the soft recording medium P and the holding tray 55 (the hard recording medium Q) can be transported. Also, since power is transmitted to the auxiliary transportation mechanism 67 via a gear train 66, it is possible to perform the movement start operation of moving the holding tray 55 from the accommodation position 54 and the movement end operation of returning the holding tray 55 to the accommodation position 54.

Since the output control of the driving motor 7 is performed by the control device 200 (refer to FIG. 6), it is possible to control the rotation speed of the transportation driving roller 35. Accordingly, it is possible to change the feeding amount of the holding tray 55 during the transportation.

Further, the transportation driving roller 35 of the transportation roller 34 and the discharge driving roller 44 of the discharge roller 43 are connected to the same driving motor 7 so as to move in a synchronized manner.

Furthermore, since the roller driving shaft 35*a* is provided with a clutch device (not shown), when the engagement position of the clutch device is appropriately changed, it is possible to selectively transmit the power of the roller driving shaft 35*a* to the feeding device 3, the automatic gap adjusting mechanism, the capping device, and the ink supply pump (which are not shown in the drawings).

FIG. 5A is a perspective view illustrating a schematic configuration of the holding tray, and FIG. 5B is a sectional view taken along the line VB-VB of FIG. 5A.

The holding tray 55 is configured as a rectangular plate-shaped member having a length shorter than the entire movement length of the reciprocation movement from the accommodation position to the setting position shown in FIGS. 2 to 4 and a small depth. The holding tray 55 has a plurality of areas arranged in the transportation direction of the front surface 55*a*. Specifically, there are provided a plane area A1, which is used to hold the hard recording medium Q in the transportation direction in a horizontal posture, and sloped areas A2 and A3, which are respectively inclined toward the rear surface 55*b* at the edges of both ends of the transportation direction.

In the plane area A1 in the front surface 55*a* of the holding tray 55, a setting concave portion (holding portion) 71 is provided at a position slightly closer to the front position than the center position in the direction (width direction) perpendicular to the transportation direction so as to set the hard recording medium Q thereon, and a holding convex portion 72 is provided at the center position in order to hold the hard recording medium Q. As the hard recording medium Q which can be set on the holding tray 55, various optical disks may be used, such as a CD-R, a CD-RW, a DVD-R, a DVD-RW having a diameter of 12 cm or 8 cm or a Blu-ray disk having gained attention as a next generation optical disk or other optical disks to be developed in the future.

In the holding tray 55 of the embodiment, as illustrated in FIG. 5B, the distance L1 from the rear end in the transportation direction of the setting concave portion 71 to the sloped area A3 is formed to be shorter than the distance L2 (refer to FIG. 8A) from the nipping point of the transportation roller 34 to the recording position of the recording head 42.

As illustrated in FIGS. 5A and 5B, in the front end 80 of the holding tray 55 in the sloped area A2, the front edge 80*a* is formed in an uneven pectinate shape, and a plurality of convex portions therein are formed as claws 84 which are inclined forward.

Meanwhile, the rear end 90 of the holding tray 55 in the sloped area A3 is formed as a slope 91 which is inclined backward in a portion except for both corner portions in the width direction. The slope 91 is formed as a multi-stage slope, where the slope path length in the transportation direction is longer than the slope path length of the claw 84, and the slope angle is gentle compared with the claw 84.

The above-described transportation driven roller 36 comes into continuous contact with the slope 91, the front surface 55*a*, and the claw 84 of the holding tray 55.

In addition, in the vicinity of the left and right corner portions of the rear end 90 of the holding tray 55, there are provided tongue-shaped connection pieces 75L and 75R which are rotatably connected to front ends 74*a* and 74*a* of left and right guide arms 74L and 74R of a movement mechanism 59 to be described later.

Returning to FIGS. 1 and 2, the reciprocation movement path 56 includes a lower path constituting member 62 which supports the rear surface 55*b* of the holding tray 55 when the holding tray 55 is located at the accommodation position 54, left and right edge guides 76L and 76R which come into contact with the left and right edges of the holding tray 55 and guide the movement of the holding tray 55, a transportation guide portion 39 which faces the rear surface 55*b* of the holding tray 55 when the holding tray 55 is located at the recording area 51, and a discharge stacker 47 which supports the rear surface 55*b* of the holding tray 55 when the holding tray 55 is located at the setting position 53.

The movement mechanism 59 includes a pair of left and right guide arms 74L and 74R which is rotatably connected to the rear end 90 of the holding tray 55, and the movement of the pair of guide arms 74L and 74R is guided by a pair of guide rails 77L (not shown in FIG. 3).

In addition, the movement in the transportation direction A and in the returning direction D opposite to the transportation direction A of the holding tray 55 is performed by the auxiliary transportation mechanism 67 in addition to the transportation roller 34. The auxiliary transportation mechanism 67 plays the role of performing the movement until the holding tray 55 located at the accommodation position 54 is transported to the recording start position 60, and the movement until the holding tray 55 located at the recording start position 60 is returned to the accommodation position 54.

As the auxiliary transportation mechanism 67, a rack and pinion mechanism may be applied as an example. In the embodiment, as illustrated in the drawing, a rack 68 is disposed in the vicinity of the right rear corner portion in the front surface 55*a* of the holding tray 55, and a pinion 69 is disposed in the terminal end of the gear train 66 for transmitting the power of the roller driving shaft 35*a* so as to mesh with the rack 68.

Figure 6:
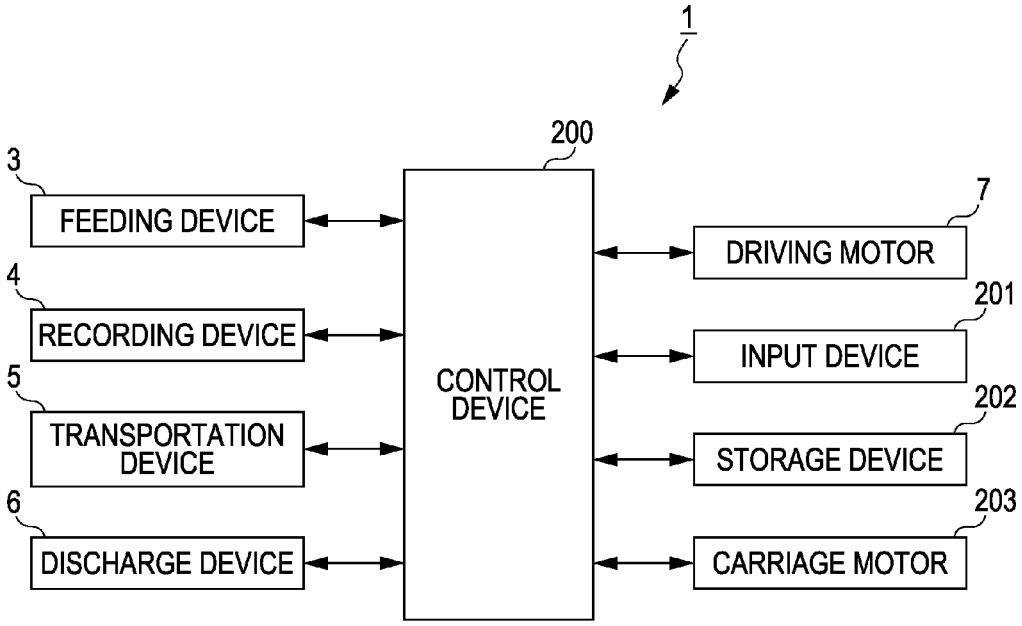
FIG. 6 is a block diagram illustrating an electrical configuration of a control device.

FIG. 6 is a block diagram illustrating an electrical configuration of an ink jet printer 1 of the embodiment.

The ink jet printer 1 of the embodiment includes the control device 200 which controls the entire operation. The control device 200 is connected to an input device 201 which inputs a variety of information relating to the operation of the ink jet printer 1, and a storage device 202 which stores a variety of information relating to the operation of the ink jet printer 1. In addition, the control device 200 is electrically connected to the feeding device 3, the recording device 4, the transportation device 5, the discharge device 6, the driving motor 7, the carriage motor 203, and the like, and electrically controls them, thereby controlling the entire operation of the ink jet printer 1.

In addition, in the embodiment, the storage device 202 stores a calculation equation for calculating the rotation speed of the transportation driving roller 35 or the transportation position of the holding tray 55 using the rotation amount as a variable of the transportation driving roller 35. In addition, the rotation amount and the like until the slope 91 of the holding tray 55 reaches the nipping point of the transportation roller 34 are obtained in advance, and the transportation position of the holding tray 55 is calculated on the basis of the data. Accordingly, when the slope 91 of the holding tray 55 reaches the nipping point of the transportation roller 34 (the discharge roller 43), the rotation driving operation of the transportation driving roller 35 (the discharge driving roller 44) is controlled. In the embodiment, the feeding amount in the rear end of the holding tray 55 in the transportation direction is corrected in such a manner that the driving control is performed so as to reduce the rotation amount of the transportation driving roller 35.

Operation of Ink Jet Printer

Figure 7:
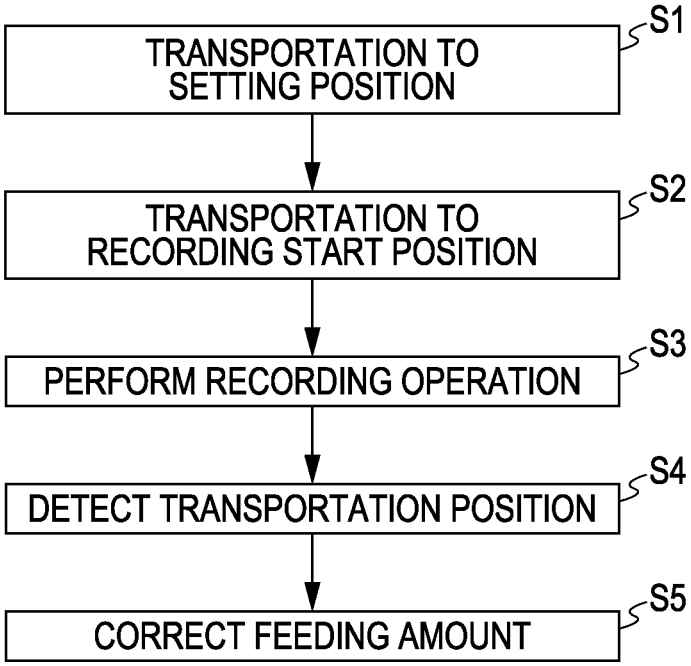
FIG. 7 is a flowchart illustrating an operation of an ink jet printer.

Next, the ink jet printer 1 of the embodiment is capable of performing a recording operation on the soft recording medium P and the hard recording medium Q, but herein, the recording operation for the hard recording medium Q will be described in detail. FIG. 7 is a flowchart illustrating the operation of the ink jet printer 1, and FIG. 8 is an explanatory diagram illustrating the operation of the ink jet printer 1. In addition, FIGS. 2 to 4 are appropriately used for reference.

As illustrated in FIG. 7, the ink jet printer 1 transports the holding tray 55 from the accommodation position 54 (FIG. 2) to the setting position 53 (FIG. 4) (Step S1), transports the holding tray 55 from the setting position 53 (FIG. 4) to the recording start position 60 (FIG. 3) (Step S2), performs the recording operation on the recording medium in the holding tray 55 (Step S3), detects the transportation position of the holding tray 55 (Step S4), corrects the feeding amount of the holding tray 55 (Step S5), and transports the holding tray 55 from the recording end position 61 (FIG. 3) to the setting position 53 (FIG. 4) (Step S6).

Hereinafter, the operation of the ink jet printer will be described with reference to the separate cases of (1) the accommodation of the holding tray, (2) the setting of the recording medium, (3) the start of the recording, and (4) the end of the recording.

1. Case of Accommodation (FIG. 2)

In the case where the holding tray 55 is located at the accommodation position 54, as shown in the drawing, the left and right guide arms 74L and 74R are accommodated in a compact posture, overlapping with each other in the vertical direction in the rear space of the lower path constituting member 62.

2. Case of Setting of Recording Medium (FIG. 3)

Then, when the control device 200 performs the recording operation on the hard recording medium Q, the holding tray 55 is moved from the accommodation position 54 to the setting position 53 by the auxiliary transportation mechanism 67 and the transportation roller 34 (Step S1). That is, when the power of the roller driving shaft 35*a* is transmitted to the rack 68 of the front surface 55*a* of the holding tray 55 via the gear train 66 and the pinion 69, the holding tray 55 starts to move forward (toward the downstream side in the transportation direction). Then, when the front edge 80*a* of the holding tray 55 reaches the nipping point of the transportation roller 34, the power transmission from the auxiliary transportation mechanism 67 ends, and the holding tray 55 reaches the setting position 53 due to the start of the power transmission from the transportation roller 34.

In addition, even in the case where the hard recording medium Q subjected to the recording operation is extracted from the holding tray 55, the hard recording medium is extracted forward by the movement stroke.

3. Case of Start of Recording (FIG. 3)

Figure 8A:
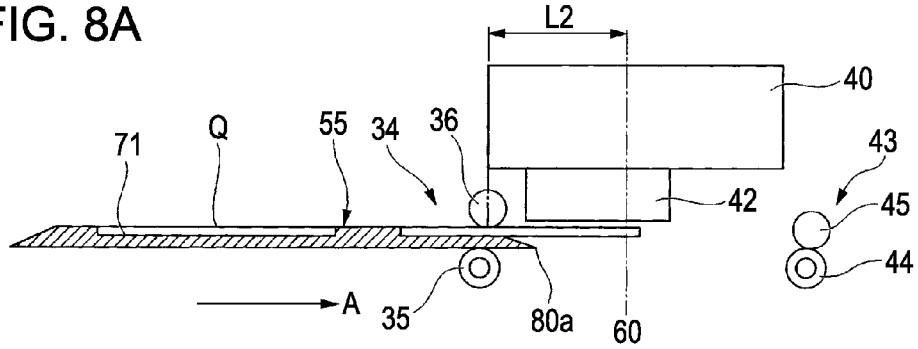
FIGS. 8A-8D are explanatory diagrams illustrating an operation of the ink jet printer.

Then, when a user sets the hard recording medium Q on the setting concave portion 71 of the holding tray 55, the holding tray 55 having the hard recording medium Q set thereon is returned by the transportation roller 34 so as to be disposed at the recording start position 60 of FIGS. 4 and 8A (Step S2). Next, the holding tray 55 is inserted into the transportation path facing the recording head 42 by the transportation force generated by the transportation roller 34 so as to be further transported toward the transportation direction A. At this time, the holding tray is transported while being pinched by the transportation driving roller 35 coming into contact with the rear surface thereof and the transportation driven roller 36 coming into contact with the front surface thereof. In addition to the transportation, each color of ink is ejected downward from the recording head 42 to the entire width of the recording surface of the hard recording medium Q by the reciprocation movement of the carriage 40 moving in the width direction (the direction perpendicular to the transportation direction), thereby starting the desired recording operation (Step S3).

Figure 8B:
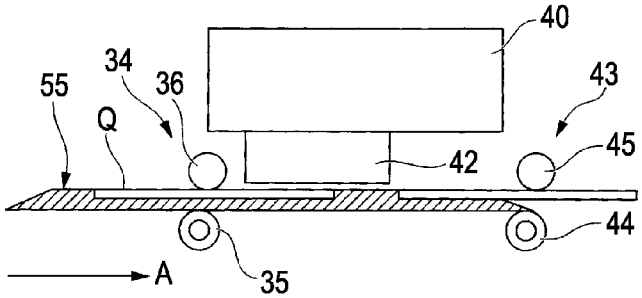
Figure 8C:
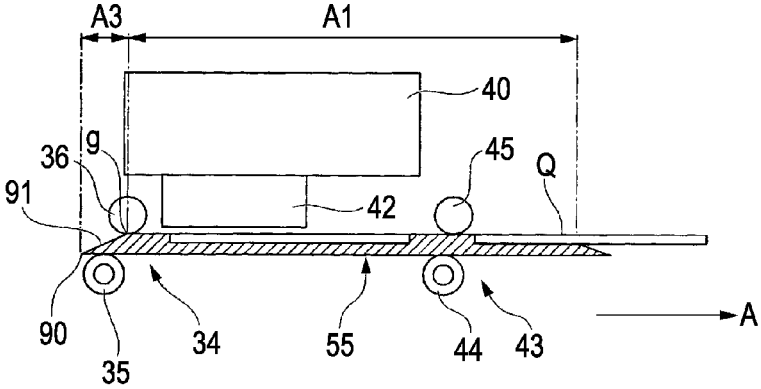
Figure 8D:
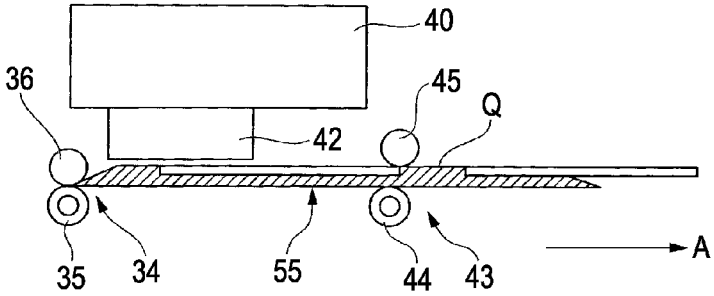

As illustrated in FIG. 8B, during a time when the recording operation is performed on the hard recording medium Q, the control device 200 detects the transportation position of the holding tray 55 using the transportation roller 34 (Step S4). Then, as shown in FIG. 8C, when it is determined that the sloped area A3 of the holding tray 55 reaches the nipping point of the transportation roller 34, the control device 200 corrects the feeding amount of the holding tray 55 using the transportation roller 34 by controlling the transportation force (rotation amount) of the transportation driving roller 35 (Step S5). Herein, as shown in FIGS. 8B to 8C, the rotation control is performed until the sloped area A3 passes by at least the nipping point.

In this case, the rotation amount (transportation force) of the transportation driving roller 35 is controlled by applying a predetermined torque to the driving motor 7. Specifically, the rpm of the transportation driving roller 35 is decreased while applying a torque resisting a phenomenon in which the holding tray 55 is pushed by the slope 91 of the rear end 90 in the transportation direction. Likewise, the feeding amount of the holding tray 55 is changed in response to the plane area A1 and the sloped area A3 which are set on the front surface 55*a* of the holding tray 55.

In the embodiment, the boundary between the plane area A1 and the sloped area A3 is set to the boundary, and the rotation control of the transportation driving roller 35 is performed in the cases of transporting the plane area A1 and the sloped area A3. That is, when the boundary g between the plane area A1 and the sloped area A3 of the holding tray 55 reaches the nipping point of the transportation roller 34, the feeding amount is corrected by reducing the rotation amount of the transportation driving roller 35. In addition, the rotation control of the transportation driving roller 35 may be performed immediately before reaching the sloped area A3 (the boundary g).

In addition, the transportation roller 34 and the discharge roller 43 are adapted to be moved in a synchronized manner by the same driving motor 7. For this reason, the control device 200 controls the rotation amount (transportation force) of the discharge driving roller 44 by applying a torque, which is the same as the torque applied to the transportation driving roller 35, to the discharge driving roller 44 of the discharge roller 43.

In addition, since the holding tray 55 is used in the case of performing a recording operation on the recording surface of the hard recording medium Q, as shown in FIG. 3, a platen gap PG between the recording head 42 and the platen 38 is enlarged upward by operating the automatic gap adjusting mechanism (not shown) before the recording operation is started, thereby setting the platen gap PG for the hard recording medium Q.

4. Case of End of Recording (FIG. 3)

Then, as illustrated in FIG. 3, when the holding tray 55 is transported to the recording end position 61, the recording operation for the recording surface of the hard recording medium Q is terminated. The position of the front end 80 of the holding tray 55 depicted by the dashed line of FIG. 3 indicates the state where the holding tray is located at the recording end position 61.

As described above, in the ink jet printer 1 of the embodiment, the feeding amount upon transporting the holding tray 55 using the transportation roller 34 is corrected for the rear end of the holding tray 55.

Generally, an urging force is applied to at least one of the transportation driving roller 35 and the transportation driven roller 36, and the holding tray 55 is transported while being pinched between the pair of rollers 35 and 36. For this reason, when the rear end 90 of the holding tray 55, that is, the slope 91 inclined backwards reaches the nipping point of both rollers 35 and 36, the holding tray 55 is applied with an urging force in the transportation direction by the pinching force of both rollers 35 and 36. For this reason, a so-called "kicking away" phenomenon in which the transportation speed increases is generated in the rear end of the holding tray 55, and the feeding amount is changed.

In addition, since the holding tray 55 of the embodiment is formed to be short in the transportation direction, the gap between the plane area A1 and the sloped area A3 set on the front surface 55*a* of the holding tray 55 becomes shorter than the gap between the nipping point of the transportation roller and the recording position of the recording head 42 in the transportation direction. For this reason, since the sloped area A3 (the slope 91 of the rear end 90) of the holding tray 55 reaches the nipping point of the transportation roller 34 before the recording operation performed on the hard recording medium Q ends, the kicking away phenomenon is generated, thereby causing a problem in that the recording operation cannot be performed satisfactorily.

Here, in the embodiment, the feeding amount of the holding tray 55 is corrected during the transportation by controlling the transportation force (rotation amount) of the transportation driving roller 35 when the sloped area A3 (the slope 91 of the rear end 90) of the holding tray 55 reaches the nipping point of the transportation roller 34. Here, in the case where the sloped area A3 (the rear end 90) of the holding tray 55 reaches the nipping point of the transportation roller 34, the rotation amount (transportation force) of the transportation driving roller 35 is controlled to be small by applying a torque to the driving motor 7, in order to resist the above-described kicking away phenomenon. Likewise, the feeding amount is corrected, in order to obtain a uniform feeding amount of the holding tray 55 between the plane area A1 and the sloped area A3 set on the front surface 55*a* of the holding tray 55.

Further, in the above-described embodiment, the transportation roller 34 and the discharge roller 43 are adapted to move in a synchronized manner by the same driving motor 7. For this reason, the control device 200 corrects the transportation amount by controlling the rotation amount (transportation force) of the discharge driving roller 44 to be decreased in such a manner that the same torque as that of the transportation driving roller 35 is applied to the discharge driving roller 44 of the discharge roller 43.

Likewise, when the transportation amount is corrected by changing the rotation amount of the transportation driving roller 35 using the plane area A1 and the sloped area A3 of the holding tray 55, it is possible to obtain a uniform transportation amount by suppressing variation in the transportation amount of the holding tray 55 during the transportation. Accordingly, since it is possible to prevent stripes, stains, or black or white banding from being generated on the recording surface, it is possible to obtain clear image quality. Further, since the feeding amount of the holding tray 55 is accurately controlled, it is possible to improve the precision in the detection of the central position of the holding tray 55, and to perform a satisfactory recording operation.

While the preferred embodiment of the invention has been described with reference to the accompanying drawings, it is needless to say that the invention is not limited to the example. It is obvious that various modifications and corrections can be made by persons skilled in the art within the scope of the technical spirit described in the claims, and it is understood that modifications and corrections are, of course, included in the technical scope of the invention.

For example, in the above-described embodiment, the transportation position of the holding tray 55 is detected by the rotation amount or the like of the transportation driving roller 35, but a separate detection means may be provided. For example, the transportation position may be detected by providing an imaging means or the like, and imaging the boundary position between the plane area A1 and the sloped area A3 of the holding tray 55.

What is claimed is:

1. A recording apparatus comprising:

a holding tray which is inserted in a transportation path facing a recording head, and is capable of holding a recording medium on a top surface thereof, the holding tray having a first area used to horizontally hold the recording medium and a sloped area provided in a rear end in a transportation direction and inclined toward a bottom surface thereof as it becomes closer to a rear edge and a front end, wherein the holding tray is configured such that the recording medium extends past the front end in the transportation direction when the recording medium is set in the holding tray;

a driving roller which comes into contact with the bottom surface of the holding tray;

a driven roller which comes into contact with the top surface of the holding tray and pinches the holding tray between the driving roller and the driven roller; and a control device which controls the driving roller in response to the case of transporting the first area of the holding tray and the case of transporting the sloped area thereof, and decreases the rotation amount of the driving roller upon a boundary between the first area and the sloped area reaching a nipping point between the driving roller and the driven roller.

2. The recording apparatus according to claim 1, wherein the control device has a function of controlling the driving roller, in order that the rotation amount is further reduced in the case of transporting the sloped area of the holding tray, compared with the case of transporting the first area thereof.

3. The recording apparatus according to claim 1, wherein the holding tray includes a holding portion which is provided in the first area, in order to hold the recording medium, and wherein a distance from the rear end of the holding portion in the transportation direction to the sloped area is shorter than a distance from a nipping point between the driving roller and the driven roller to a recording position using the recording head.

4. A driving control method for a driving roller, the method comprising:

controlling a driving operation of a transportation driving roller in response to the cases of transporting a first area of a holding tray and transporting a sloped area thereof when the holding tray is transported while being pinched between a driving roller coming into contact with a bottom surface of the holding tray and a driven roller coming into contact with a top surface of the holding tray, and the driving operating being controlled to decrease the rotation amount of the driving roller upon a boundary between the first area and the sloped area reaching a nipping point between the driving roller and the driven roller, wherein the holding tray is inserted in a transportation path facing a recording head, is capable of holding a recording medium on a top surface thereof, and then has a first area used to horizontally hold the recording medium and a sloped area provided in a rear end in a transportation direction and inclined toward a rear surface thereof as it becomes closer to a rear edge and a front end, wherein the holding tray is configured such that the recording medium extends past the front end in the transportation direction when the recording medium is set in the holding tray.

5. The driving control method according to claim 4, further comprising controlling the driving roller so that the rotation amount is further reduced in the case of transporting the sloped area of the holding tray, compared with the case of transporting the first area thereof.

* * * * *